US006523870B2

(12) United States Patent
Schlack

(10) Patent No.: US 6,523,870 B2
(45) Date of Patent: Feb. 25, 2003

(54) ACTUATOR HANDLE MECHANISM

(75) Inventor: Richard E. Schlack, Rising Sun, MD (US)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/991,191

(22) Filed: Nov. 21, 2001

(65) Prior Publication Data

US 2002/0117864 A1 Aug. 29, 2002

Related U.S. Application Data

(60) Provisional application No. 60/252,205, filed on Nov. 21, 2000.

(51) Int. Cl.[7] ..... E05B 3/00

(52) U.S. Cl. ..... 292/336.3; 292/36; 292/DIG. 31

(58) Field of Search ..... 292/336.3, 36, 292/DIG. 31; 70/108, 109, DIG. 31

(56) References Cited

U.S. PATENT DOCUMENTS 3,785,686 A * 1/1974 Armstrong ..... 292/336.3
4,312,528 A * 1/1982 Hall ..... 292/92
4,601,499 A * 7/1986 Kim ..... 292/36
4,828,299 A * 5/1989 Poe ..... 292/139
4,925,221 A * 5/1990 Carmody ..... 292/200
4,951,486 A * 8/1990 Braun ..... 70/208
5,375,894 A * 12/1994 Schlack ..... 292/36
5,791,700 A * 8/1998 Biro ..... 292/7
6,318,135 B1 * 11/2001 Johnsen ..... 70/208

* cited by examiner

*Primary Examiner*—Gary Estremsky
(74) *Attorney, Agent, or Firm*—Paul & Paul

(57) ABSTRACT

An actuator handle mechanism used in conjunction with a multi-point latching system is adapted to allow a panel or door, such as a panel or a door on a cabinet to be opened and closed. The handle mechanism comprises at a handle, at least two end caps, at least two links, and a crossbar. The mechanism allows a user to open the system by rotating a handle around a vertical axis, as opposed to the horizontal axis.

8 Claims, 7 Drawing Sheets

ACTUATOR HANDLE MECHANISM

CROSS-REFERENCE TO RELATED APPLICATIONS

This application claims priority to U.S. Provisional Application Serial No. 60/252,205, filed Nov. 21, 2000.

BACKGROUND OF THE INVENTION

1. Field of the Invention

The present invention relates generally to latching devices and more particularly to a handle mechanism for securing a first member, such as a door, panel, or a similar closure member in a closed position relative to a second member, such as a corresponding door, panel, or similar closure member.

2. Brief Description of the Prior Art

Although many other handles and multi-point latching systems are currently available, there are few systems, which combine the elements of both a handle used in conjunction with a multi-point latch by allowing a user to open the system by rotating a handle around a vertical axis, as opposed to the customary horizontal axis indicated in the prior art, especially in a simple and easy to assemble mechanism that is visually satisfying.

There are many paddle type actuators in the prior art. These actuators usually cause a single pawl to be retracted and do not allow for multi-point operation. Some paddle type actuators are outfitted with pivot plates, which allow the actuator to open two or three latching points. These systems work only in a "pull" mode; that is, they can pull the remote latches open, but rely on spring force to close the system.

There is a need for a simple, actuator handle to be used in conjunction with a multi-point latching system, which is constructed with few individual parts, is easy to assemble, and provides for user-friendly installation and operation and is aesthetically pleasing. Moreover, a need also exists to provide a handle mechanism, which allows a cabinet designer the flexibility to match an actuator motion to the design and end user of the cabinet. Furthermore, a new handle mechanism is needed, which allows push and pull output from the mechanism.

SUMMARY OF THE INVENTION

The present invention provides an actuator handle mechanism for use in conjunction with a multi-point latching system for installation in an opening in a door or panel for releasably retaining the panel relative to a frame. For example, the multi-point latching system disclosed in prior art applications may be used. The mechanism allows a user to open the system by rotating a handle around a vertical axis, as opposed to the horizontal axis.

In the preferred embodiment, the mechanism includes a generally wedge-shaped handle, two generally wedge-shaped end caps, two generally triangular shaped links, and a crossbar. A lock mechanism may be added to one of the end caps. The end caps connect with the handle, and the handle connects with the links, which connect to the crossbar. The cross bar then connects to a toggle pivot, which allows for opening and closing of the mechanism. The crossbar is constrained to linear motion by slots in the end caps, so it matches the linear motion of the toggle pivot. The links join the crossbar to the handle and allow the crossbar to translate while the handle pivots. A slot in the link accommodates a lock pawl which when engaged prevents the handle from opening. The links and crossbar are designed to cover up, and therefore restrict user access to, any pinch points. This handle mechanism used in conjunction with an actuator mechanism of a multi-point latching system allows for push and pull output from the mechanism. Thus, this feature allows use of the handle with a multi-point latching system, and provides compression at the latching points.

The handle is operated in the following manner: the operator actuates the handle by pulling it forward, which is a clockwise rotational motion. This action engages the links, one located on each side of the handle, and thereby causes the link to pull the crossbar forward towards the handle, thus opening the panel or door. When the handle is pushed rearward, the links are also pushed rearward, thereby causing the crossbar to move rearward. The toggle pivot connected to the crossbar extends, which causes a pair of toggle links to collapse thus allowing the handle to fully close.

It is an object of the present invention to provide an actuator handle mechanism to work in conjunction with a multi-point latching system, which is useful for securing a door panel such as a cabinet door or panel.

It is another object of the present invention to provide an actuator handle mechanism, which will allow a user to open the system by rotating a handle around a vertical axis, as opposed to the horizontal axis.

Still another object of the present invention is to provide an actuator handle mechanism, which is constructed with few individual parts, is easy to assemble, and provides for user-friendly installation and operation and is aesthetically pleasing.

Yet another object of the present invention is to provide an actuator handle mechanism, which allows a cabinet designer the flexibility to match an actuator motion to the design and end user of the cabinet.

Another object of the present invention is to provide an actuator handle mechanism, which allows push and pull output from the mechanism.

Yet another object of the present invention is to provide an actuator handle mechanism, which comprises a minimum number of parts.

These and other objects of the present invention will become more readily apparent when taken into consideration with the following description and the attached drawings.

DETAILED DESCRIPTION OF THE PREFERRED EMBODIMENTS

Figure 1:
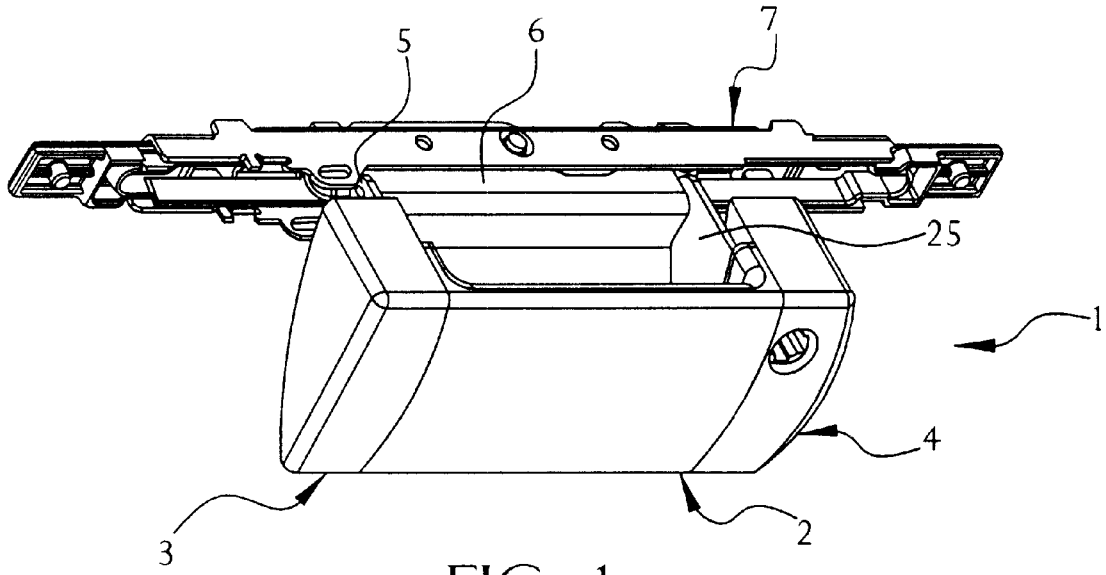
FIG. 1 is a perspective view of the actuator handle mechanism according to the present invention shown in the closed position.
Figure 5:
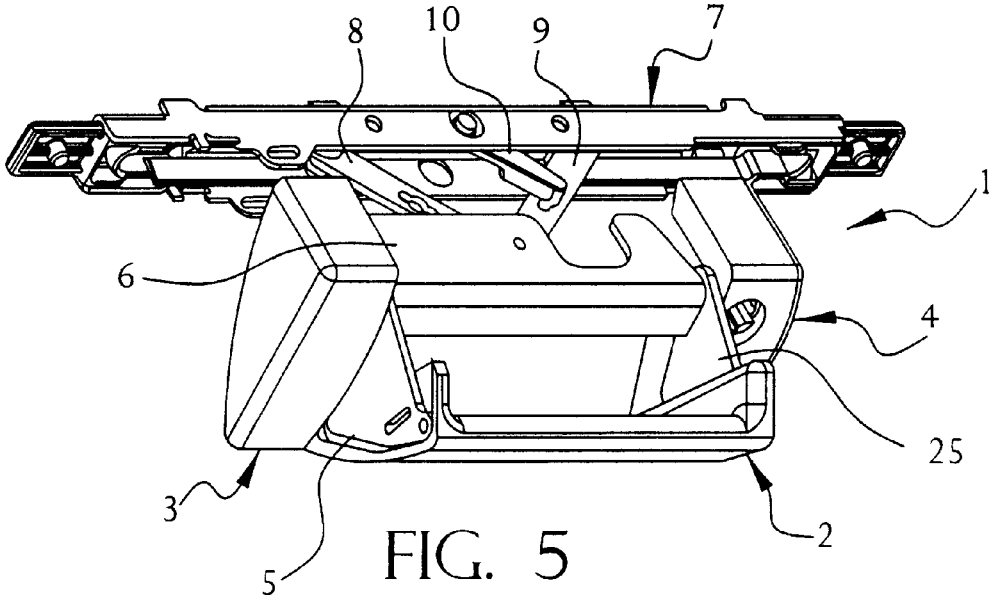
FIG. 5 is a perspective view of the actuator handle mechanism according to the present invention shown in the open position.
Figure 2:
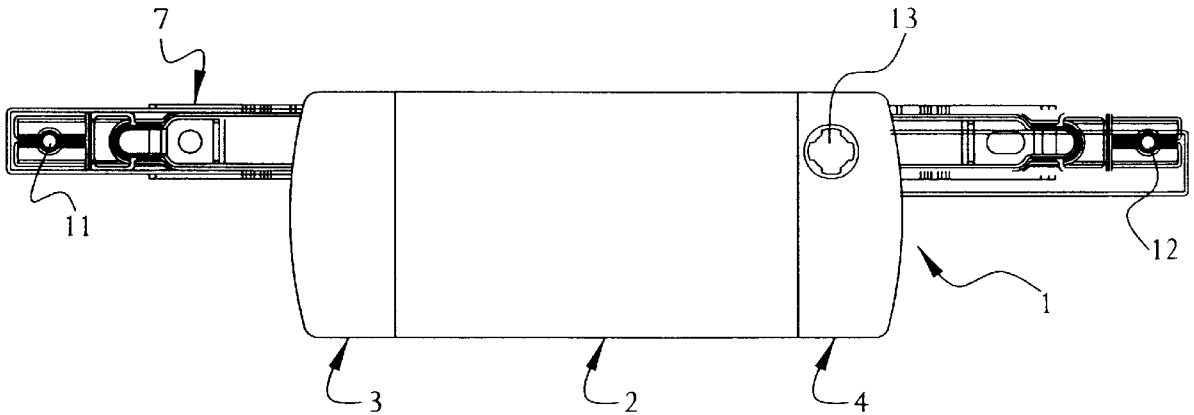
FIG. 2 is a front view of the actuator handle mechanism of FIG. 1.
Figure 3:
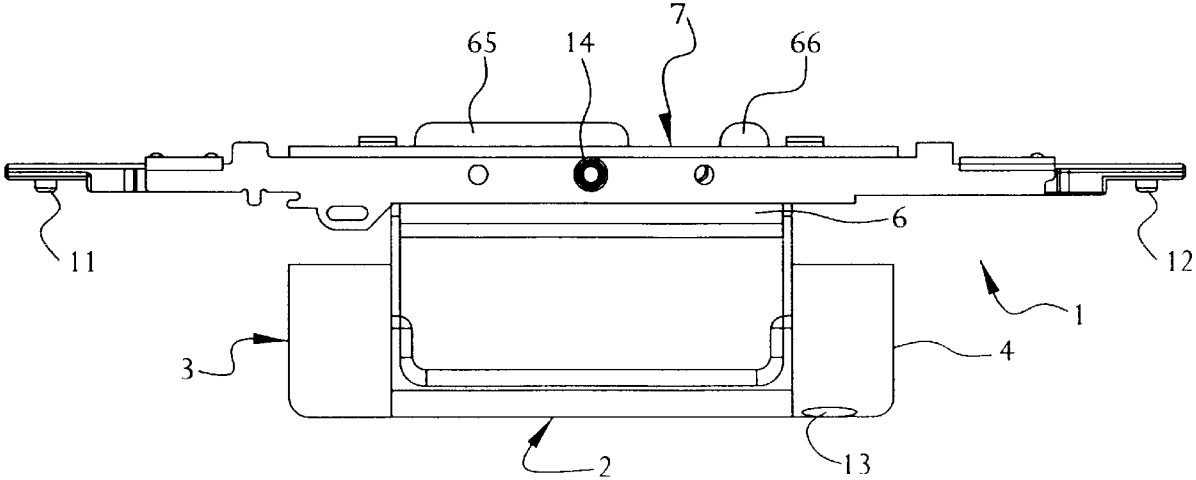
FIG. 3 is a top plan view of the actuator handle mechanism of FIG. 1.
Figure 4:
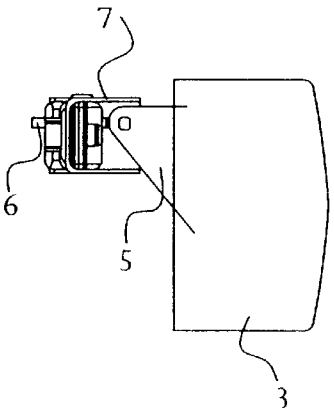
FIG. 4 is an elevated side view of the actuator handle mechanism of FIG. 1.
Figure 7:
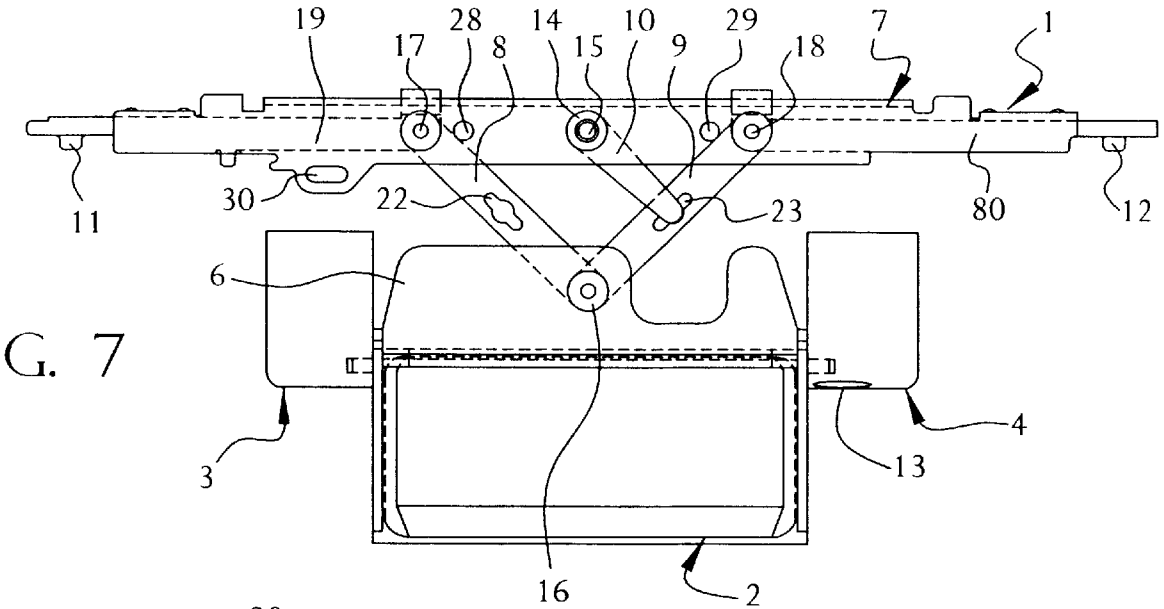
FIG. 7 is a top plan view of the actuator handle mechanism of FIG. 5.
Figure 6:
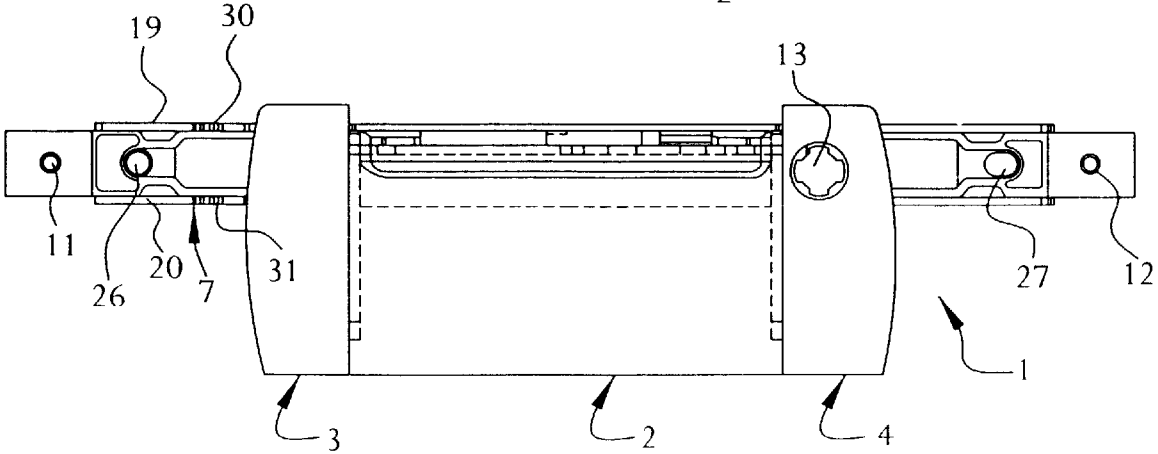
FIG. 6 is a front view of the actuator handle mechanism of FIG. 5.
Figure 8:
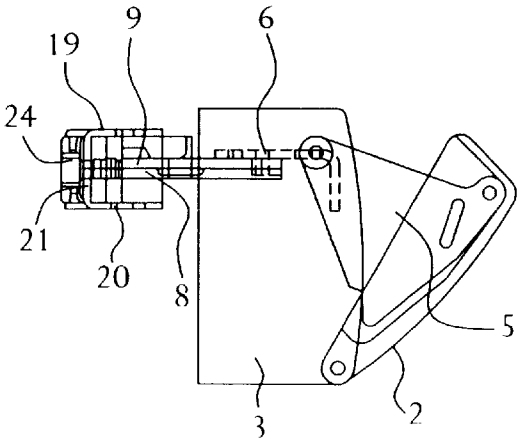
FIG. 8 is a side elevated view of the actuator handle mechanism of FIG. 5.
Figure 9:
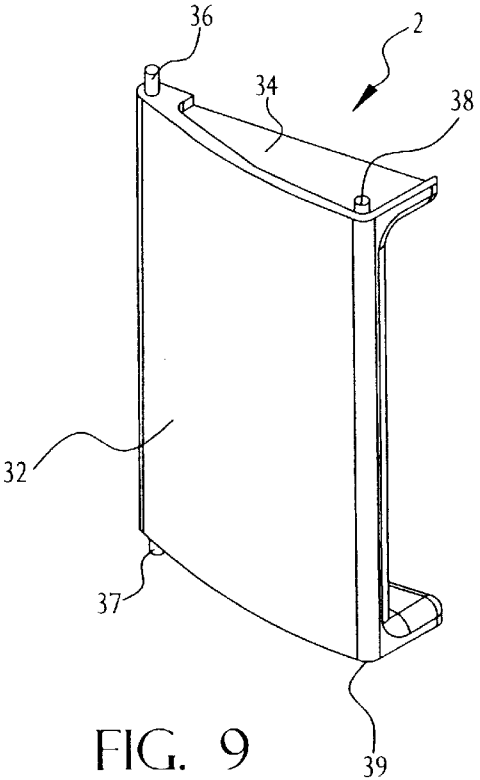
FIG. 9 is a perspective view of the handle according to the present invention.
Figure 10:
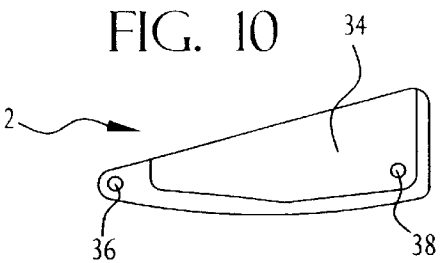
FIG. 10 is a side view of the handle of FIG. 9.
Figure 11:
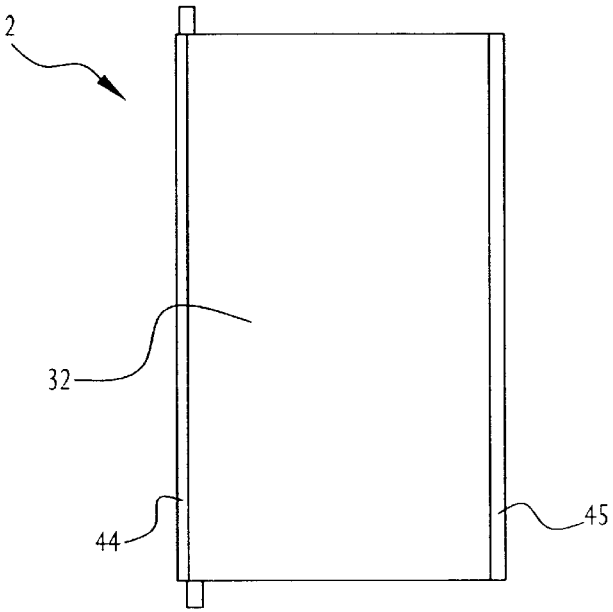
FIG. 11 is a front view of the handle of FIG. 9.
Figure 12:
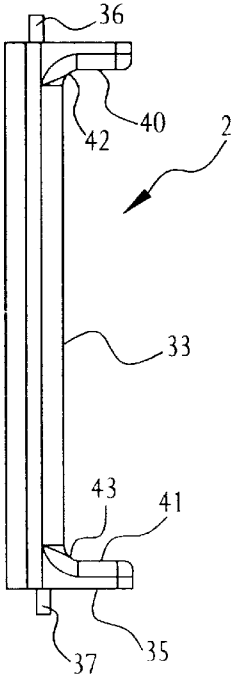
FIG. 12 is a top view of the handle of FIG. 9.
Figure 13:
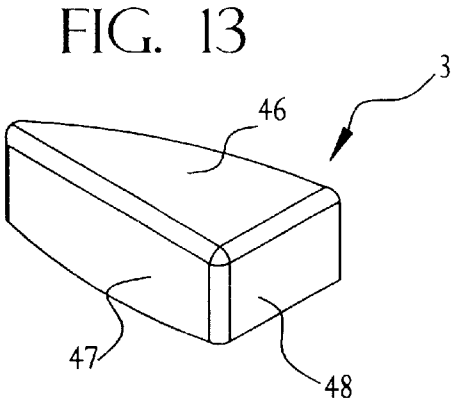
FIG. 13 is a perspective view of the first end cap according to the present invention.

Referring now to the drawings in detail, wherein like reference numerals indicate like elements throughout the several views, there is shown in FIGS. 1–4 various views of an actuator handle mechanism 1 in a closed position. The handle mechanism 1 comprises a handle 2, a first end cap 3, a second end cap 4, a first link 5, a second link 25, a crossbar 6, and a toggle mechanism 7.

FIGS. 5–8 illustrate the handle mechanism 1 in the closed position. The rack 80 is generally elongated and is dimensioned and configured to receive the handle mechanism 1. Toggle mechanism 7 comprises a rack 80, a plurality of toggle links 8, 9, a cross link 10, and a plurality of rod connectors 11, 12. The toggle mechanism 7 further comprises means for attaching said toggle mechanism 7 to a panel (not shown), wherein said attachment means is embodied in a plurality of holes 26, 27. Other apertures 28, 29, 30, 31 are further included on said rack 80. The rack 80, which is generally C-shaped, further comprises an upper portion 19, a lower portion 20, and a joining cross portion 21, with a plurality of rear openings 24 in said cross portion 21.

Said plurality of toggle links 8, 9 are connected to said plurality of rod connectors 11, 12 by a plurality of toggle link connections 17, 18 respectively. Toggle link 8 is connected to toggle link 9 by a toggle pivot 16. Toggle links 8, 9 each comprise a pivot eyelet 22, 23 respectively. A cross link 10 is connected to said toggle link 9 through the pivot eyelet 23. A cross link knob 15 extends from one end of said cross link 10, and extends through a cross link attachment hole 14 of toggle mechanism 7.

FIGS. 9–12 further illustrate the handle 2, wherein said handle 2 is generally triangular I shape and comprises a front surface 32, a rear surface 33, a recessed left surface 34, and a recessed right surface 35. A pair of end cap pegs 36, 37 extend from said left surface 34 and right surface 35 respectively. Likewise a pair of link pegs 38, 39 extend from said left surface 34 and right surface 35 respectively. The handle 2 further comprises a pair of inner side walls 40, 41 extending to a pair of curved joining walls 42, 43 respectively, which then terminate at said rear surface 33. The front surface 32 terminate with rounded edges 44, 45 on opposite sides.

FIGS. 13–16 detail first end cap 3, which connects onto said handle 2. Wherein said first end cap 3 is generally triangular in shape and comprises an outer side surface 46, an outer front surface 47, and an outer top surface 48. Peg receiving means embodied by a peg bore 49 is included in said first end cap 3, which receives end cap peg 36 of handle 2.

Figure 17:
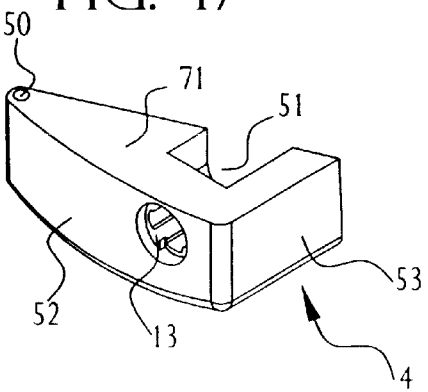
FIG. 17 is a perspective view of the second end cap according to the present invention.
Figure 14:
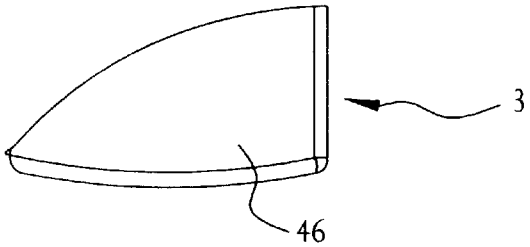
FIG. 14 is a side view of the first end cap of FIG. 13.
Figure 16:
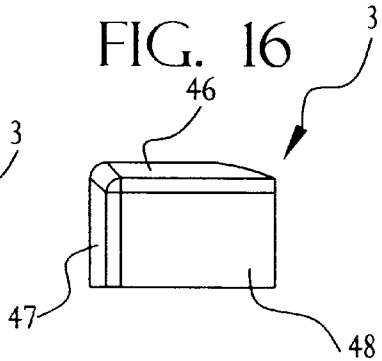
FIG. 16 is a top view of the first end cap of FIG. 13.
Figure 15:
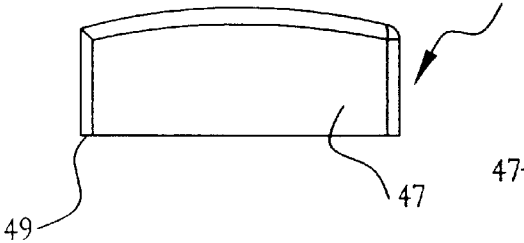
FIG. 15 is a front view of the first end cap of FIG. 13.
Figure 19:
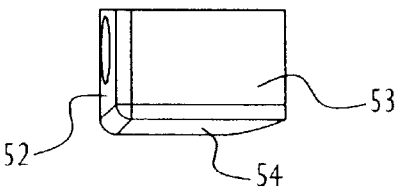
FIG. 19 is a top view of the second end cap of FIG. 17.
Figure 18:
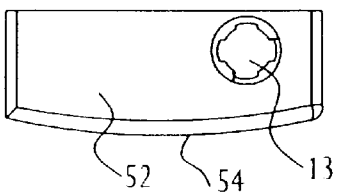
FIG. 18 is a front view of the second end cap of FIG. 17.

FIGS. 17–19 further show second end cap 4, which also connects onto said handle 2. Said second end cap 4, which is generally triangular in shape, comprises an inner side surface 71, an outer front surface 52, an outer top surface 53, and an outer side surface 54. Peg receiving means embodied as a peg bore 50 is included in said second end cap 4, which receives end cap peg 31 of handle 2. Means for locking said handle 2 is housed in a locking means recess 13, which extends to an aperture 51.

Figure 20:
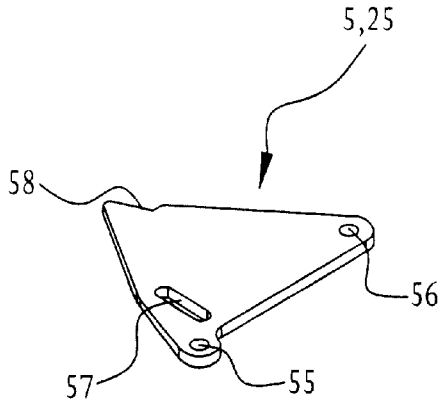
FIG. 20 is a perspective view of the link according to the present invention.
Figure 21:
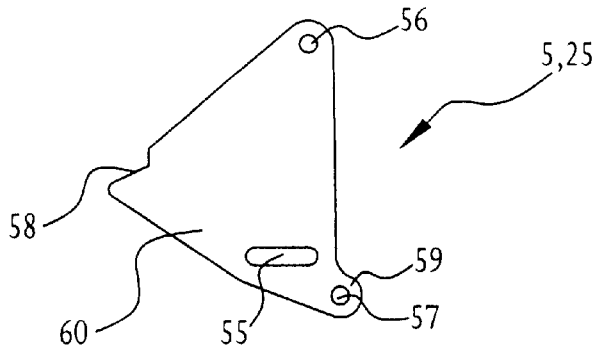
FIG. 21 is a top view of the link of FIG. 20.
Figure 22:
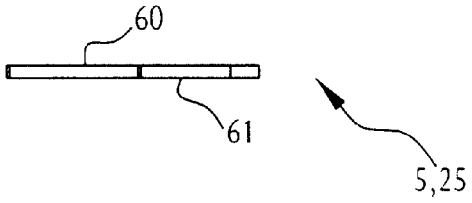
FIG. 22 is a side view of the link of FIG. 20.
Figure 23:
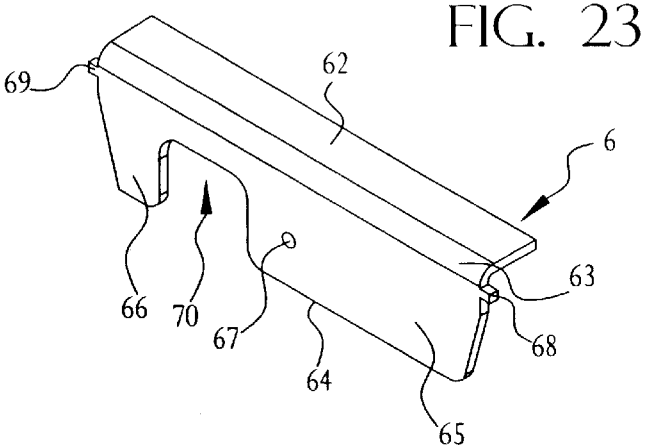
FIG. 23 is a perspective view of the crossbar according to the present invention.
Figure 26:
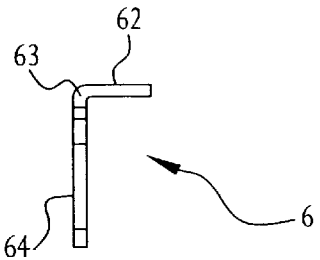
FIG. 26 is a side view of the crossbar of FIG. 23.
Figure 24:
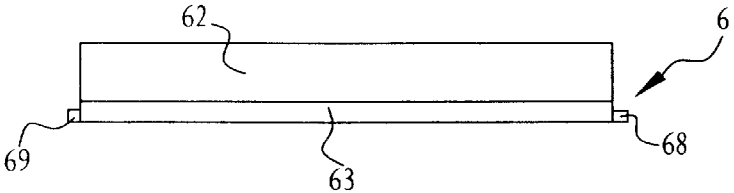
FIG. 24 is a front view of the crossbar of FIG. 23.
Figure 25:
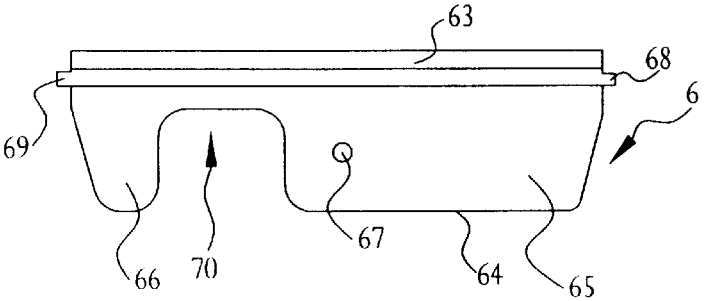
FIG. 25 is a top view of the crossbar of FIG. 23.

Next, FIGS. 20–22 illustrate first link 5 and second link 25, which are adapted to connect said handle 2 with said crossbar 6. First and second link 5 and 25 comprise a first surface 60, a second surface 61, an extended portion 59, and a notch 58. Said extended portion 59 comprises handle peg hole 57, which receives link peg 38 (for first link 5) and link peg 39 (for second link 25). A crossbar peg hole 56 is also included on first and second link 5 and 25. Finally, a slot 55 is included to receive a locking member (not shown) from means for locking said handle 2 (not shown).

FIGS. 23–26 further show the crossbar 6, which connects to said first and second links 5 and 25, and when pushed forward by pushing the handle 2, causes translational movement of toggle pivot 16. The crossbar 6, which is generally L-shaped, comprises a front portion 62, a curved connecting portion 63, and a top portion 64. Wherein said top portion 64 further comprises a first portion 65 and a second portion 66. A toggle pivot connecting means 67 shown as a hole is included in first portion 65 of said top portion 64 of said crossbar 6. Toggle pivot connecting means 67 connects said toggle links 8, 9 together via toggle pivot 16. A cutout portion 70 is further included on said crossbar 6. Finally, a pair of link pegs 68, 69 extend from said crossbar 6. Said link pegs 68, 69 connect into crossbar peg hole 56 of first link 5 and second link 25, and are guided to move in a linear fashion by extending through links 5, 25 and into slots (not shown) in end caps 3, 4.

Other modifications to the above description can be made consistent with the spirit and scope of the invention disclosed as disclosed in the Summary of the Invention, the Brief Description of the Drawing Figures, and the Detailed Description of the Preferred Embodiments. While the above description constitutes the preferred embodiment of the present invention, it will be appreciated that the invention is subject to modification, variation and change, without departing from the proper scope or fair meaning of the present invention. In this regard, while the various features of the present invention have been shown and described in relation to a panel or door, such as for example that of a cabinet, it will be understood that many of these features are suitable in connection with latching of other members.

I claim:

1. An actuator handle mechanism for securing a first member to a second member, the actuator handle mechanism comprising:

(a) a handle mechanism comprising a handle, a pair of fink members, and a crossbar; and (b) a toggle mechanism supported by a housing rack, said toggle mechanism comprising a plurality of toggle links, wherein said handle mechanism is attached to said toggle mechanism by a pivoting joint attaching a pair of said toggle links, wherein force in the forward or rearward direction on said handle mechanism causes opening and closing of said handle mechanism, respectively, and translational movement of said pivoting joint.

2. The actuator handle mechanism of claim 1, wherein said toggle links collapse into said housing rack in the closed position and extend outward in the open position.

3. The actuator handle mechanism of claim 2, wherein at least one of said pair of said toggle links is connected to a rod connector.

4. The actuator handle mechanism of claim 3, wherein said toggle mechanism further comprises a cross link attached to said housing rack at a first end and a toggle link at a second end.

5. The actuator handle mechanism of claim 1, wherein said link members have a first end attached to said handle and second end attached to said crossbar.

6. The actuator handle mechanism of claim 5, wherein said crossbar is attached to said pivoting joint, wherein said pivoting joint and said crossbar are limited to corresponding linear movement during opening and closing of said handle mechanism.

7. The actuator handle mechanism of claim 6, wherein said handle mechanism further comprises a pair of end caps which support said handle.

8. The actuator handle mechanism of claim 7, wherein at least one of said end caps has an aperture for attachment of a locking means for locking of said handle mechanism in the closed position.

* * * * *

UNITED STATES PATENT AND TRADEMARK OFFICE

CERTIFICATE OF CORRECTION

PATENT NO. : 6,523,870 B2 
DATED : February 25, 2003
INVENTOR(S) : Richard E. Schlack It is certified that error appears in the above-identified patent and that said Letters Patent is hereby corrected as shown below:

Column 4,
Line 19, replace “31” with -- 3 --;

Column 5,
Line 2, replace “fink” with -- link --.

Signed and Sealed this

Eighth Day of April, 2003

JAMES E. ROGAN
*Director of the United States Patent and Trademark Office*